US007506387B1

(12) United States Patent
Scordato et al.

(10) Patent No.: US 7,506,387 B1
(45) **Date of Patent: *Mar. 24, 2009**

(54) METHOD AND APPARATUS FOR PATIENT TRANSFER

(75) Inventors: Emil A. Scordato, Clearwater, FL (US); J. Michael Doust, St. Petersburg, FL (US); Scott Hadley, Palm Harbor, FL (US)

(73) Assignee: Winco, Inc., Ocala, FL (US)

( * ) Notice: Subject to any disclaimer, the term of this patent is extended or adjusted under 35 U.S.C. 154(b) by 0 days.

This patent is subject to a terminal disclaimer.

(21) Appl. No.: 11/959,684

(22) Filed: Dec. 19, 2007

(51) Int. Cl.
*A61G 7/10* (2006.01)

(52) U.S. Cl. ..... 5/81.1 R; 5/81.1 HS; 5/88.1

(58) Field of Classification Search ..... 5/81.1 R, 5/88.1, 81.1 C, 81.1 HS, 81.1 T
See application file for complete search history.

(56) References Cited

U.S. PATENT DOCUMENTS

| | | | | |
|---|---|---|---|---|
| 2,827,642 | A | 3/1958 | Huff | |
| 4,048,681 | A * | 9/1977 | Baulch et al. | 5/81.1 R |
| 4,087,873 | A * | 5/1978 | Ohkawa | 5/81.1 C |
| 5,163,189 | A * | 11/1992 | DeGray | 5/86.1 |
| 5,651,149 | A | 7/1997 | Garman | |
| 5,937,456 | A * | 8/1999 | Norris | 5/88.1 |
| 6,341,393 | B1 | 1/2002 | Votel | |
| 6,349,432 | B1 * | 2/2002 | Scordato et al. | 5/81.1 R |
| 6,378,148 | B1 * | 4/2002 | Votel | 5/81.1 HS |
| 6,496,991 | B1 | 12/2002 | Votel | |
| 6,772,456 | B2 | 8/2004 | Votel | |
| 6,834,402 | B2 * | 12/2004 | Hanson et al. | 5/81.1 R |
| 6,877,176 | B2 * | 4/2005 | Houghteling | 5/655 |
| 7,240,384 | B2 * | 7/2007 | DuDonis | 5/633 |
| 7,337,477 | B2 * | 3/2008 | Scordato et al. | 5/81.1 R |
| 2002/0029418 | A1 | 3/2002 | Votel | |
| 2003/0074732 | A1 | 4/2003 | Hanson et al. | |
| 2007/0056095 | A1 | 3/2007 | Scordato et al. | |

* cited by examiner

*Primary Examiner*—Robert G Santos
(74) *Attorney, Agent, or Firm*—Larson & Larson, PA; Frank Liebenow

(57) ABSTRACT

A method for transferring a patient from a first surface to a second surface includes providing a winch having a drive system and two reels operatively coupled to the drive system. Two straps are attached to each of the reels. Two wedge cushions are provided for pushing the patient in the direction of the winch from the first surface to the second surface. The wedge cushions have a cover, an insert and an attachment mechanism for attaching them to the straps. The wedge cushions are thinner at the attachment mechanism end. The first of the two straps is passed beneath the patient and is attached to a first wedge cushion. The second of the two straps is passed beneath the patient and is attached to another wedge cushion. The reels are rotated, thereby pulling the two straps until each of the wedge cushions wedge firmly beneath the patient. Nest, the reels are rotated together, thereby pulling the two straps until the patient is transferred from the first surface to the second surface.

12 Claims, 11 Drawing Sheets

METHOD AND APPARATUS FOR PATIENT TRANSFER

CROSS-REFERENCE TO RELATED APPLICATIONS

This application is related to non-provisional application Ser. No. 11/468,087 filed Aug. 29, 2006 and non-provisional application Ser. No. 11/225,967 filed on Sep. 14, 2005; both of which are hereby incorporated by reference.

BACKGROUND OF THE INVENTION

1. Field of the Invention

This invention relates to the field of transferring patients from one surface to another, and more particularly to a system for aiding in the transfer of a patient from one support surface to another such as from a gurney to a hospital bed and visa versa.

2. Description of the Related Art

Patients are often transferred from one surface to another surface in medical facilities such as hospitals, clinics and surgery centers. For an operation, the patient is transported on a gurney, requiring a transfer from the hospital bed to the gurney and from the gurney to an operating table and vice versa when the operation is complete. Moving the patient from one surface to another is a difficult task because of the weight and bulk of the patient and the height of the surfaces which don't permit the medical staff to bend their knees to lift the patient, thereby creating severe stress on their backs and other joints and muscles, often leading to serious injuries of the medical staff. This problem is amplified when bariatric patients are involved, where the patient may weigh 400 to 800 pounds or more.

Presently, a patient may be transferred by a practice of placing a heavy-duty sheet under the patient by "log-rolling" the patient to his or her side, placing the sheet underneath the patient, rolling the patient to his or her back and then several medical staff members lifting the patient via the sheet to move the patient from one surface to another. For bariatric patients, often six or more medical staff are often required and many times, injuries occur. Injuries to interns, nurses and other medical staff are very costly to hospitals, surgery centers and the like.

Many ways have been devised to transfer patients from one surface to another. One such device is described in U.S. Pat. No. 6,484,332 to Korver, et al. and is hereby incorporated by reference. This device requires the patient be situated on a patient positioning board; but there is no way for a patient, especially a sedated bariatric patient, to be moved off the positioning board and onto a bed.

U.S. Pat. No. 5,937,456 to Norris is hereby incorporated by reference. This patent describes a device that has a series of conveyor belts. The patient must be log-rolled to his or her side, the conveyor positioned next to the patient, then the patient rolled onto the conveyor belt.

U.S. Pat. No. 6,378,148 to Votel is hereby incorporated by reference. This patent describes a system with a transfer caddy and has a sheet-like material that the patient must be positioned upon, requiring log-rolling the patient in order to position the sheet-like material under the patient. Once positioned on the sheet-like material, the patient is pulled onto the destination surface.

U.S. Pat. Publication No. 2007/0056095 to Scordato describes a patient transfer system that uses straps that pass beneath the patient and attach to a buffer cushion. The buffer cushion then pushes the patient from one surface to another surface in response to a winch pulling the straps. This system works well but the patient provides considerable resistance to being pulled across the surfaces that the present invention addresses. This patent application is hereby incorporated by reference.

What is needed is a system that will transfer a patient from one surface to another without placing undo stress on the caregivers and without resulting in undo discomfort to the patient.

SUMMARY OF THE INVENTION

In one embodiment, an apparatus for transferring a patient from a first surface to a second surface is disclosed including a winch having two reels and two straps attached to the reels. Wedge cushions are provided for pushing the patient in the direction of the winch from the first surface to the second surface. The wedge cushions each have a cover, an insert and an attachment mechanism for removably attaching them to the two straps. The wedge cushions are thinner at the end that has the attachment mechanism and thicker at an opposite end.

In another embodiment, a method for transferring a patient from a first surface to a second surface is disclosed, including providing a winch, the winch having a drive system and two reels operatively coupled to the drive system. Two straps are attached to the reels. Two wedge cushions are provided for pulling the patient in the direction of the winch from the first surface to the second surface. The wedge cushions have a cover, an insert and an attachment mechanism for removably attaching them to the two straps. The wedge cushions are thinner at their end that has the attachment mechanism and thicker at the opposite end. The method continues with passing a first of the two straps beneath the patient at a location substantially under the back of the patient and attaching the first of the two straps to a first wedge cushion at its attachment mechanism. Then, passing a second of the two straps beneath the patient at a location substantially under the knees of the patient and attaching the second straps to another wedge cushion using its attachment mechanism. Next, the reels are independently rotated, thereby pulling the two straps until each of the wedge cushions wedge firmly beneath the patient. Now, the reels are rotated together, thereby pulling the two straps until the patient is transferred from the first surface to the second surface.

In another embodiment, a patient transfer winch system for transferring a patient from a first surface to a second surface is disclosed, including a winch system having two independent reels and two straps, a first end of a first strap attached at a first reel of the two independent reels and a first end of a second strap attached to a second reel of the two independent reels, the straps adapted to wrap around the reels as the winch system turns the reels. Two wedge cushions are provided for lifting and pushing the patient in the direction of the winch from the first surface to the second surface. Each wedge cushion has a cover, an insert and a mechanism for attaching to a second end of the straps. Each wedge cushion also has a pull strap attached to a surface distal to the mechanism for attaching

BRIEF DESCRIPTION OF THE DRAWINGS

The invention can be best understood by those having ordinary skill in the art by reference to the following detailed description when considered in conjunction with the accompanying drawings in which.

DETAILED DESCRIPTION OF THE INVENTION

Figure 1A:
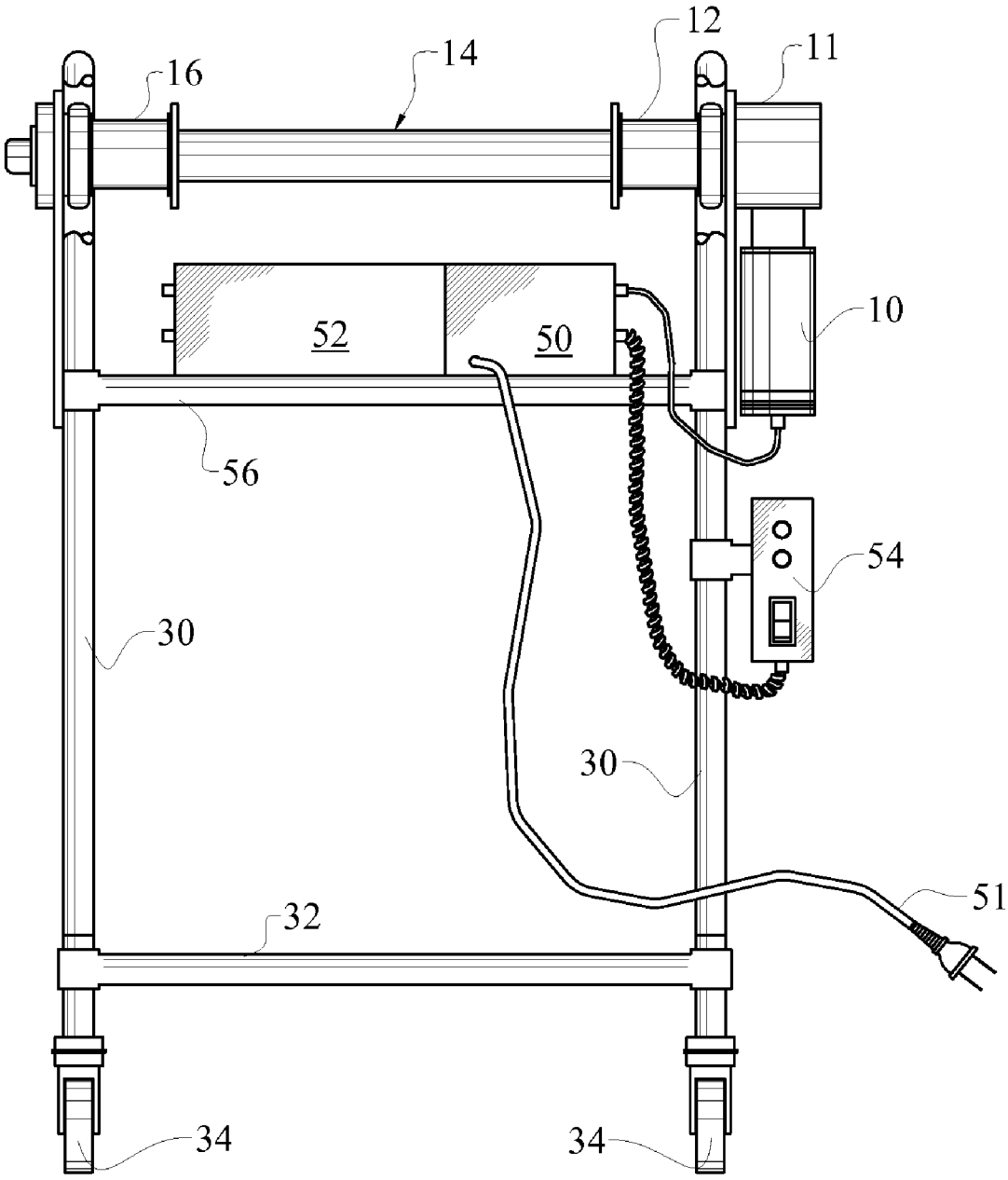
FIG. 1A illustrates a front schematic view of a system of a first embodiment of the present invention.

Reference will now be made in detail to the presently preferred embodiments of the invention, examples of which are illustrated in the accompanying drawings. Throughout the following detailed description, the same reference numerals refer to the same elements in all figures.

Referring to FIG. 1A, a front schematic view of a system of the first embodiment of the present invention is shown. The patient transfer winch system of this embodiment has one motor 10 that drives a shaft 14 through a gear box 11. The motor is controlled by a controller 50 mounted upon a support rail 56 with a detachable remote control 54. The remote control 54 has switches to control the operation of the motor and indicators to provide status such as battery charge status and system power status. In some embodiments, the switches are in the form of a joystick. The switches include, for example, motor speed and direction controls and an emergency stop. Power to the system is provided by a rechargeable battery 52, for example, a lead acid battery or nickel metal hydride battery. In some embodiments, the batteries are recharged under control of the controller 50 using external power supplied from a standard power source through power cable 51. In some embodiments, the batteries are removable and are externally charged. The patient transfer system is supported by vertical supports 30 and horizontal supports 32/56. In some embodiments, wheels 34 are provided to ease movement of the winch system.

Two reels 12/16 are coupled to the shaft 14 and will be explained in detail later. In some embodiments, a clutch (not shown) is provided on one or both of the reels 12/16 to control the transfer of rotation independently of the shaft 14 rotation and provide for correction of patient skewing during transfer. This is important, in that, it is anticipated that the reel associated with the patient's legs will need to pull its associated strap 18 (see FIG. 1B) further than the other reel. In some embodiments, one or both of the two reels 12/16 are adjustable to permit adjustment of the patient's location with respect to each other and to the patient and to accommodate differences in height between different patients.

Figure 1B:
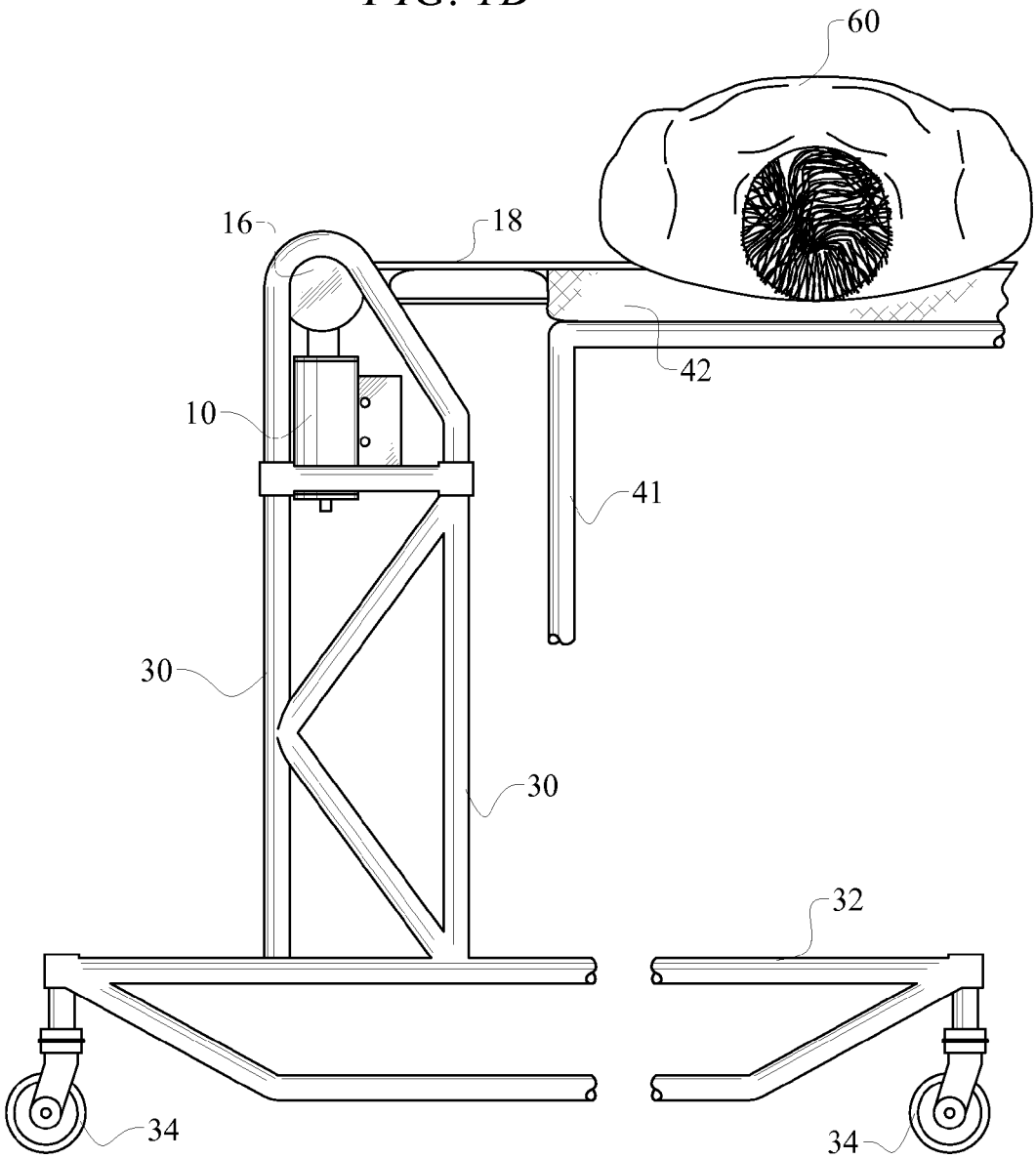
FIG. 1B illustrates a side schematic view of a system of the first embodiment of the present invention.

Referring to FIG. 1B, a side schematic view of a system of a second embodiment of the present invention is shown. In this view, more detail of the frame is visible, showing the side of the vertical supports 30 and horizontal supports 32 as well as wheels 34. One of the motors 10 is visible and one of the reels 16 with a patient transfer strap 18 passing under the patient 60, whereas the patient is lying on a surface 42 supported by supports 41.

Figure 2A:
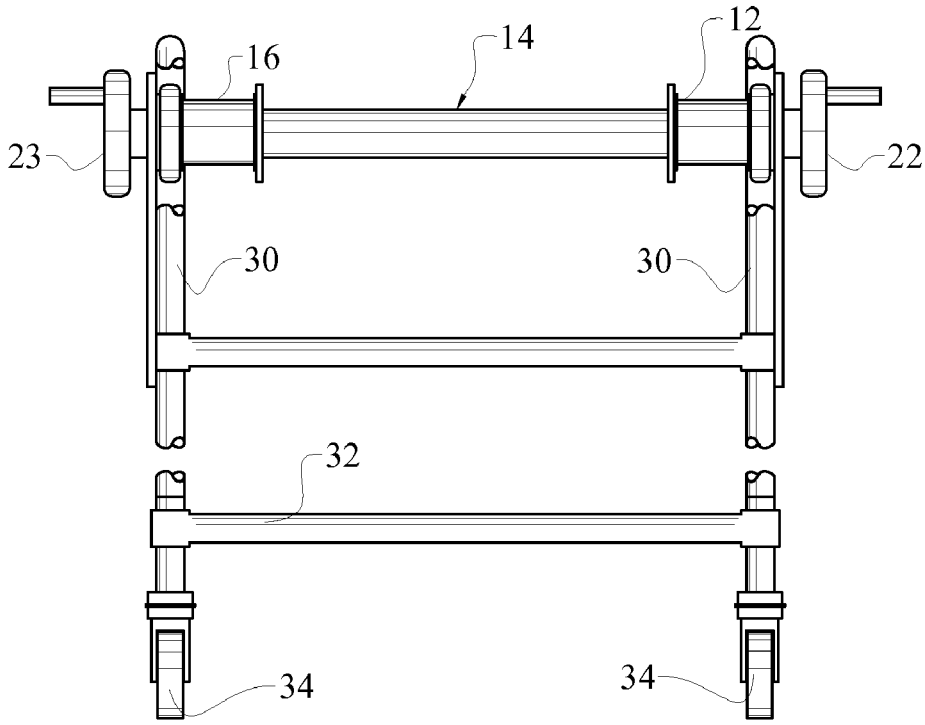
FIG. 2A illustrates a front schematic view of a system of a second embodiment of the present invention.

Referring to FIG. 2A, a front schematic view of a system of the second embodiment of the present invention is shown. The patient transfer winch system of this embodiment has two hand-cranks 22/23 that turn their respective strap reels 12/16. The strap reels 12/16 are mounted on a shaft 14 and turn independent of the shaft 14 using bearings, etc., as known in the industry. The patient transfer system is supported by vertical supports 30 and horizontal supports 32. In some embodiments, wheels 34 are provided for movement of the winch system.

Figure 2B:
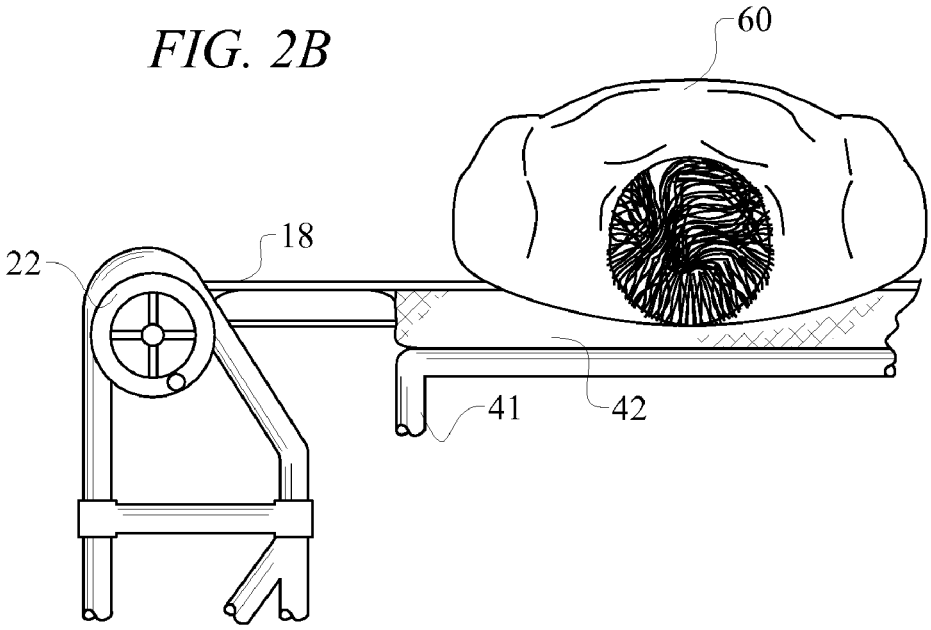
FIG. 2B illustrates a side schematic view of a system of the second embodiment of the present invention.

Referring to FIG. 2B, a side schematic view of a system of a second embodiment of the present invention is shown. One of the hand-cranks 22 is visible and a patient transfer strap 18 passes under the patient 60, whereas the patient is lying on a surface 42 supported by supports 41.

Figure 3:
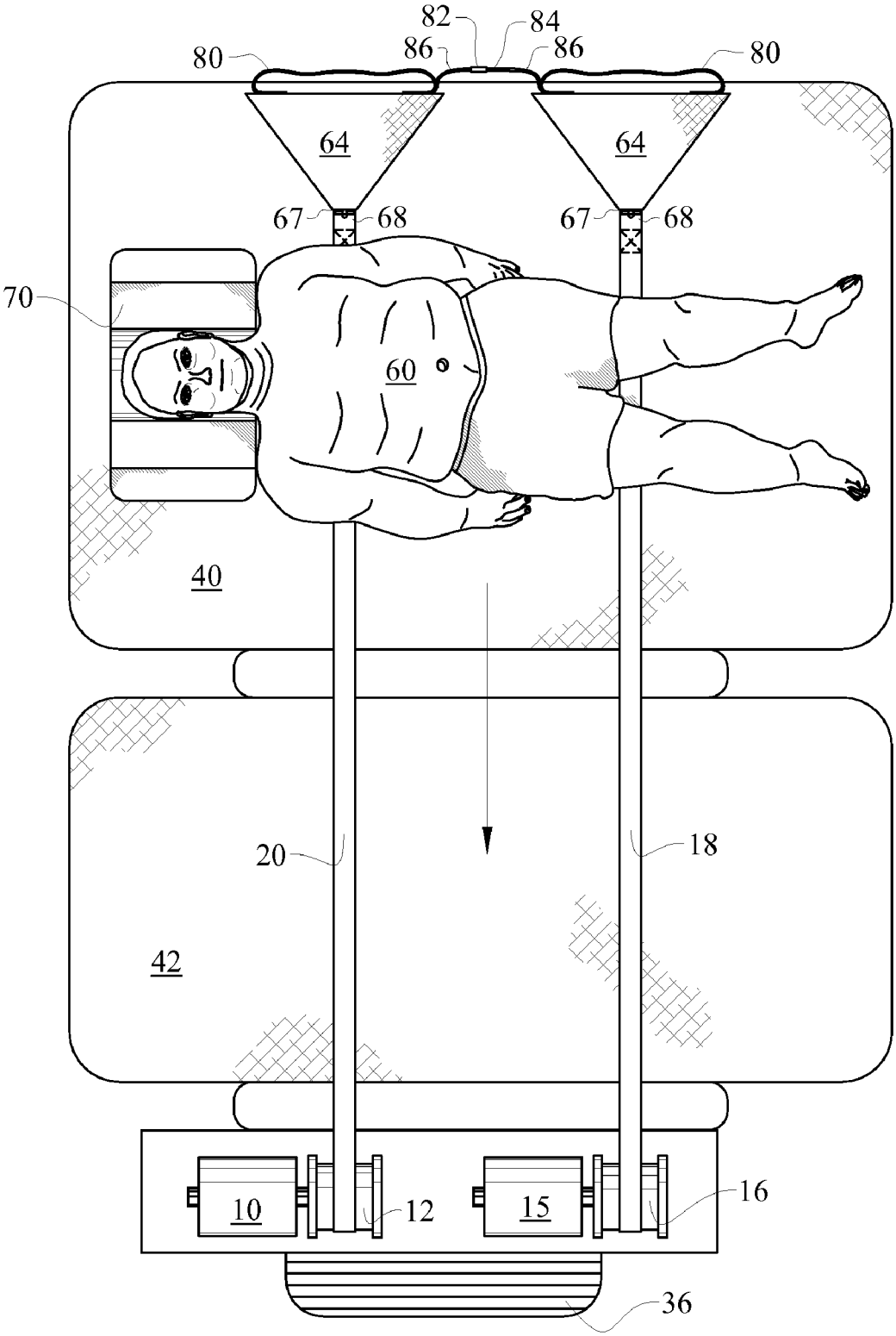
FIG. 3 illustrates a plan view of a system of a third embodiment of the present invention.

Referring to FIG. 3, a plan view of a system of the third embodiment of the present invention is shown. This embodiment shows two motors 10/15, each driving a separate reel 12/16. Not shown is the motor control system and remote control as in FIG. 1. In some embodiments, one or two joystick remote controls are provided to allow one-handed operation of both motors.

A patient transfer strap 20/18 is attached to each reel 12/16 so that as the motors 10/15 turn, the patient transfer straps 20/18 wind around the reels 12/16. The patient transfer strap is preferably made of a relatively high-strength, flexible material such as polypropylene or polyethylene. Preferably, the straps are made of a smooth, slippery material to aid in passing the straps 20/18 underneath the patient. The other ends of the patient transfer straps are passed underneath the patient 60 and are removably attached to a wedge cushion system at attachment points 67.

To assist with passing the patient transfer straps 20/18 underneath the patient without "log-rolling" the patient, an elongated, stiff device is used. One such device is described in U.S. patent application Ser. No. 11/468,087 to Scordato, et al. The device is inserted beneath the patient 60 and hooks onto an end of the patient transfer strap 20/18, and then is pulled back out from beneath the patient 60, dragging along the patient transfer strap 20/18.

In the embodiment shown, loops 68 and T-catch 67 are used to removably attach the patient transfer straps 18/20 to the wedge cushions 64, though any suitable method of removable attachment can be used without veering from the present invention. The wedge cushions 64 are described in detail later. In the preferred embodiment, the wedge cushions 64 have straps 80 to assist in removing the wedge cushions 64 from beneath the patient 60. In some embodiments, the strap 80 of one wedge cushion 64 removably connects to the strap 80 of the other wedge cushion 64 by interconnecting straps 86 and a male and female connector 82/84 as known in the industry. The patient 60 is shown lying on his or her back on a first surface 40. In some embodiments, a head cushion 70 is provided. As the motors 10/15 turn, the patient transfer straps 20/18 wrap around the reels 12/16, moving the wedge cushions 64 and hence the patient 60 from the first surface 40 to the second surface 42. The straps 20/18 bull the wedge cushions 64 and the wedge cushions 64, in turn, push the patient 60 from the first surface 40 to the second surface 42.

The head cushion 70 provides additional safety and comfort to the patient as his or her head passes over any gap between the first surface 40 and the second surface 42. In some embodiments, a step 36 is provided to allow the operator better access to the system. In some embodiments, each motor 10/15 is individually controlled to allow the operator to correct any skewing of the patient 60 as he or she moves across the surfaces 40/42.

Figure 4:
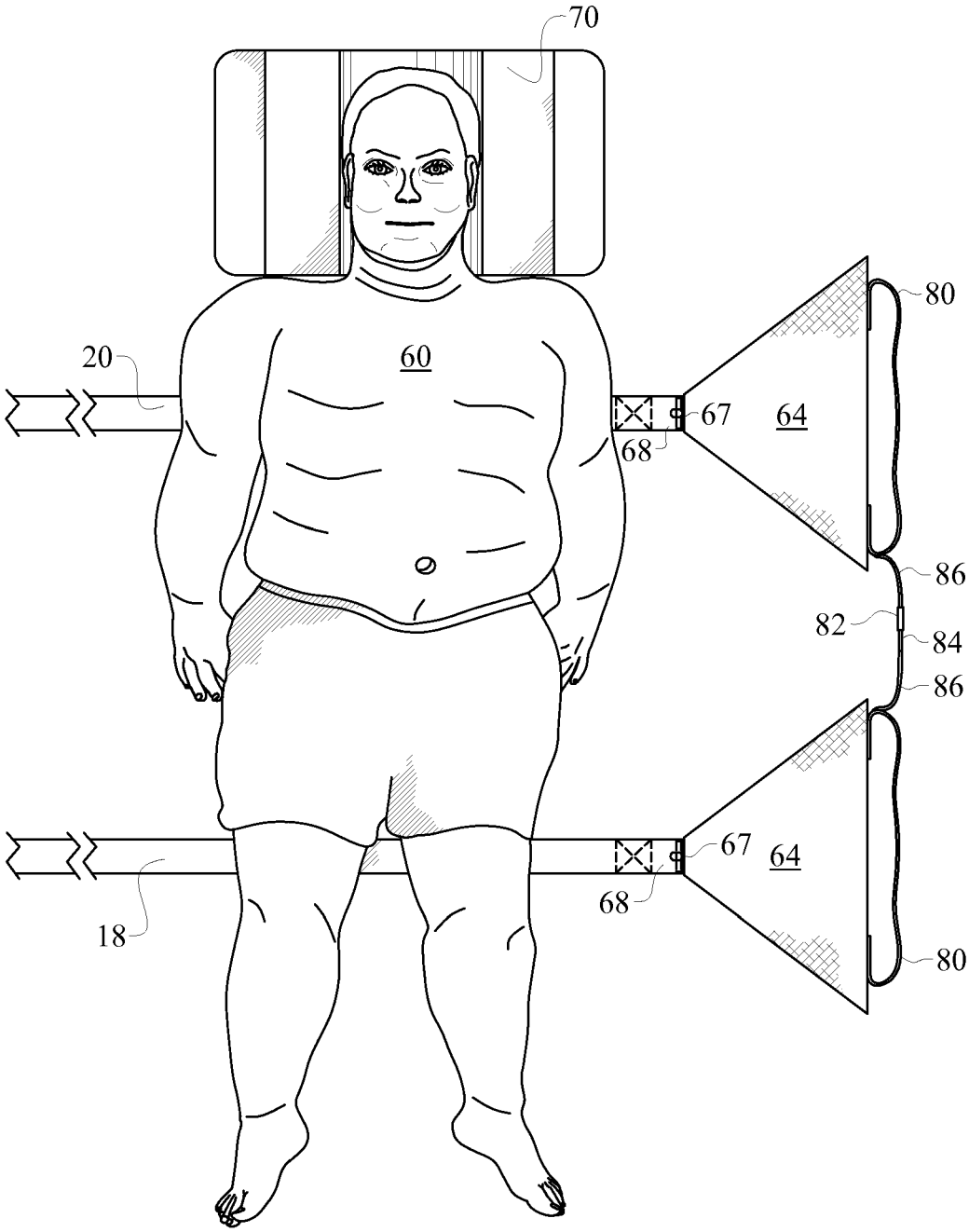
FIG. 4 illustrates a detail view of the patient transport subsystem of both embodiments of the present invention.

Referring to FIG. 4, a detail view of the patient transport subsystem of all embodiments of the present invention is shown. The straps 18/20 pass under the patient's 60 back and knees. The straps are removably attached to the wedge cushion 64. In this embodiment, the straps 18/20 have loops 68 that attach to T-catches 67 of the wedge cushions 64. The wedge cushions 64 are provided for comfort and lift of the patient 60 while transferring the patient 60 from one surface to another. In some embodiments, a head cushion 70 is provided to enhance comfort of the patient as they are transferred from one surface to another. The head cushion 70 also helps lift the head of the patient 60, easing the placement of the patient transfer strap 20.

Figure 5:
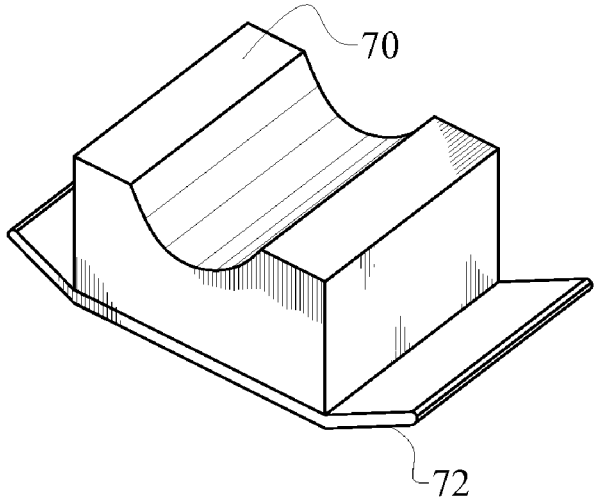
FIG. 5 illustrates a detail view of the head cushion of both embodiments of the present invention.

Referring to FIG. 5, a detail view of the head cushion of both embodiments of the present invention is shown. The head cushion 70 is composed of a soft material such as foam rubber and in some embodiments is covered with cloth or another soft material. In the preferred embodiment, a low-friction transfer surface 72 is attached to the bottom of the head cushion 70 for smoothly sliding across the surfaces and facilitating spanning of any gaps that may exist between the surfaces as the patient 60 moves. In some embodiments, the low-friction transfer surface 72 is angled or curved so as to not catch on the edge of the destination surface.

Figure 6A:
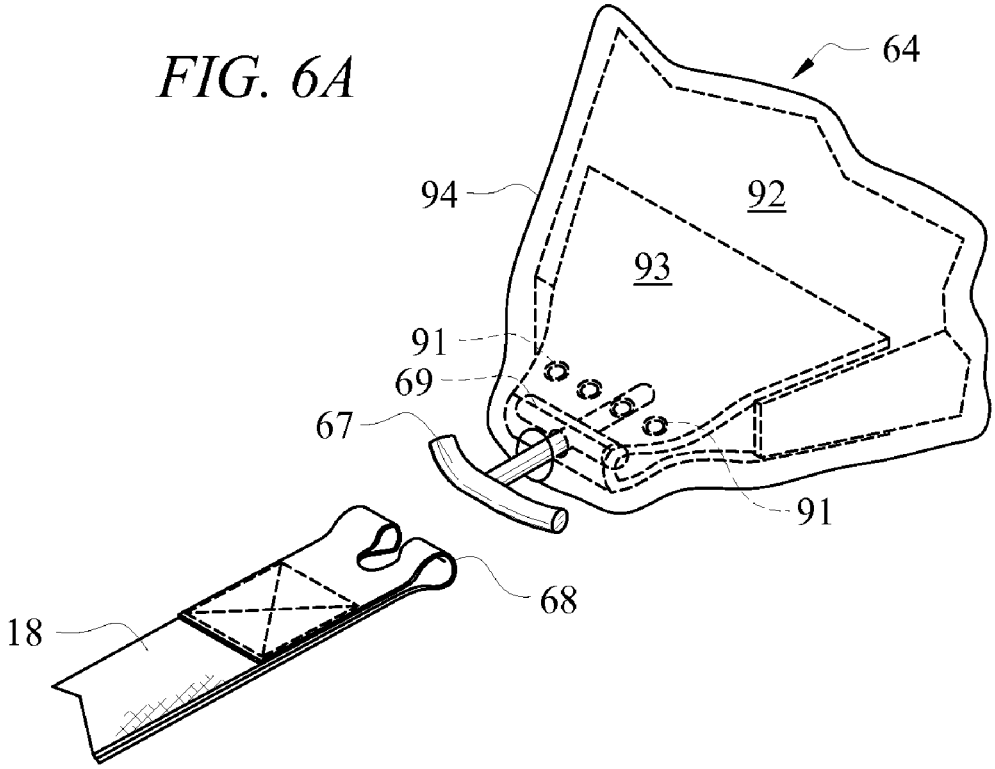
FIGS. 6A, 6B and FIG. 6C illustrate a method of attaching the wedge cushion assembly to the transport straps of both embodiments of the present invention.
Figure 6B:
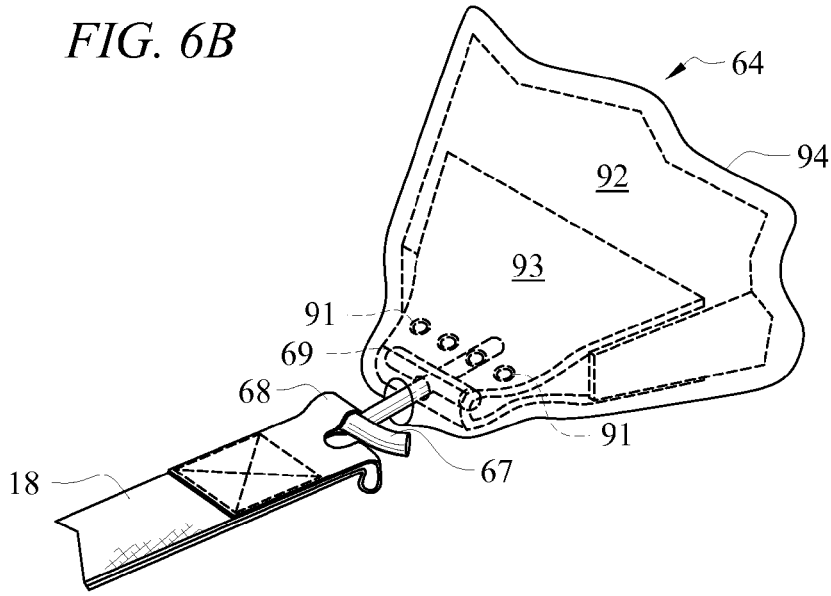
Figure 6C:
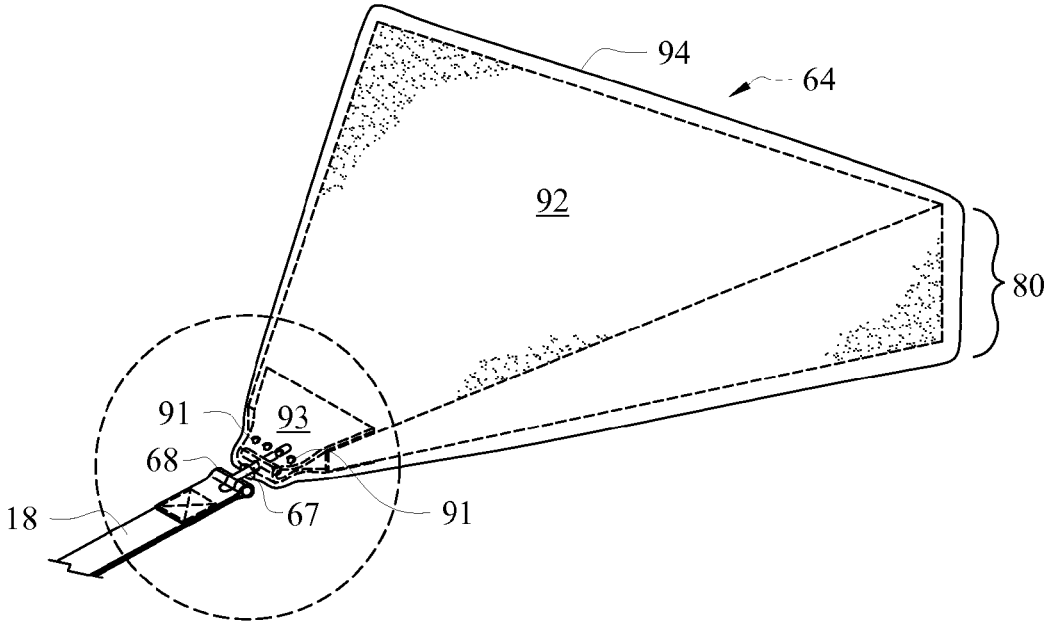

Referring to FIG. 6A and FIG. 6B, one of several methods of attaching the wedge cushion system to the transport straps of both embodiments of the present invention is shown. The strap 18 has loops 68 with openings large enough to accept the T-catch 67. Note that in the preferred embodiment, the ends of the T-catch 67 bends slightly toward the wedge cushion 64 forming an anchor shape. These bends help keep the loops 68 of the strap 18 in place before and during patient transfer operations. In FIG. 6A, the loops 68 are shown ready to be attached to the T-catch 67. In FIG. 6B, one of the loops 68 is looped over one of the prongs of the T-catch 67. In FIG. 6C, each of the loops 68 are looped over their respective prong of the T-catch 68 and the wedge cushion 64 is securely attached to the straps 18/20. In other embodiments, one end of each strap 18/20 is permanently affixed to a wedge cushion 64 and the other ends of the straps 18/20 are removably attached to the reels 12/16 (not shown).

Although the make-up of the wedge cushion 64 is anticipated in many different configurations, a triangular shape is preferred, though other various shapes are possible and included herewithin. In this exemplary triangular-shaped wedge cushion 64, the T-catch 67 has a cross member 69 that is secured to a stiff member 93 within the wedge cushion's 64 cover 94. Fasteners 91 such as rivets hold the cross member 69 between sides of the stiff member 93. In this embodiment, the stiff member 93 is bent roughly in half and partially covers the internal cushion material 92 to provide a smooth transition when the wedge cushion 64 passes beneath the patient. In some embodiments, the internal cushion material 92 is foam rubber or other suitable material. In other embodiments, the internal cushion 92 is an air or liquid bladder.

Figure 6D:
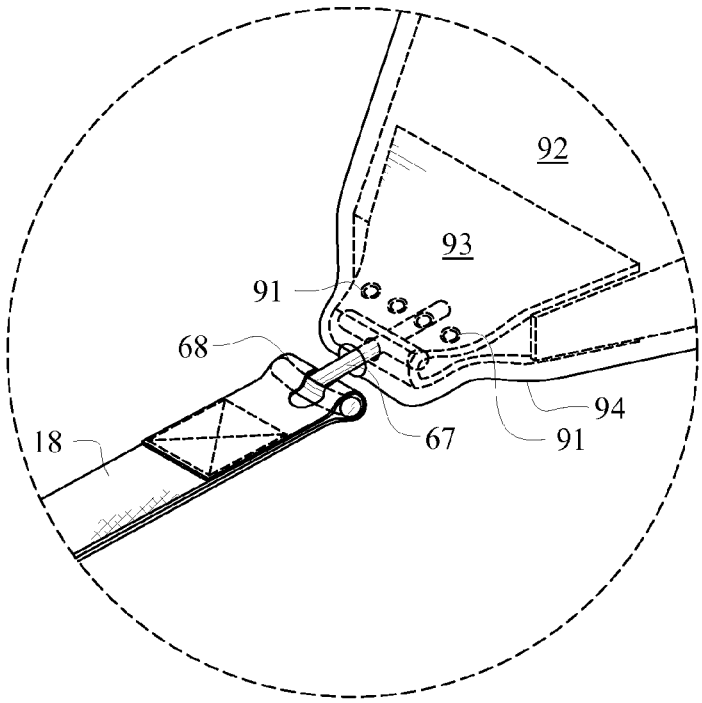
FIG. 6D illustrates a close-up view of the method of attaching the wedge cushion assembly to the transport straps of both embodiments of the present invention.

In FIG. 6D, a detail view of the wedge cushions 64 attachment mechanism is shown. Although a triangular shape is preferred, though other various shapes are possible and included herewithin. The loops 68 of the straps 18/20 are looped over the T-catch 67. In this exemplary triangular-shaped wedge cushion 64, the T-catch 67 has a cross member 69 that is secured to a stiff member 93 within the wedge cushion's 64 cover 94. Fasteners 91 such as rivets hold the cross member 69 between sides of the stiff member 93. In this embodiment, the stiff member 93 is bent roughly in half and partially covers the internal cushion material 92 to provide a smooth transition when the wedge cushion 64 passes beneath the patient. In some embodiments, the internal cushion material 92 is foam rubber or other suitable material. In other embodiments, the internal cushion 92 is an air or liquid bladder.

Figure 6E:
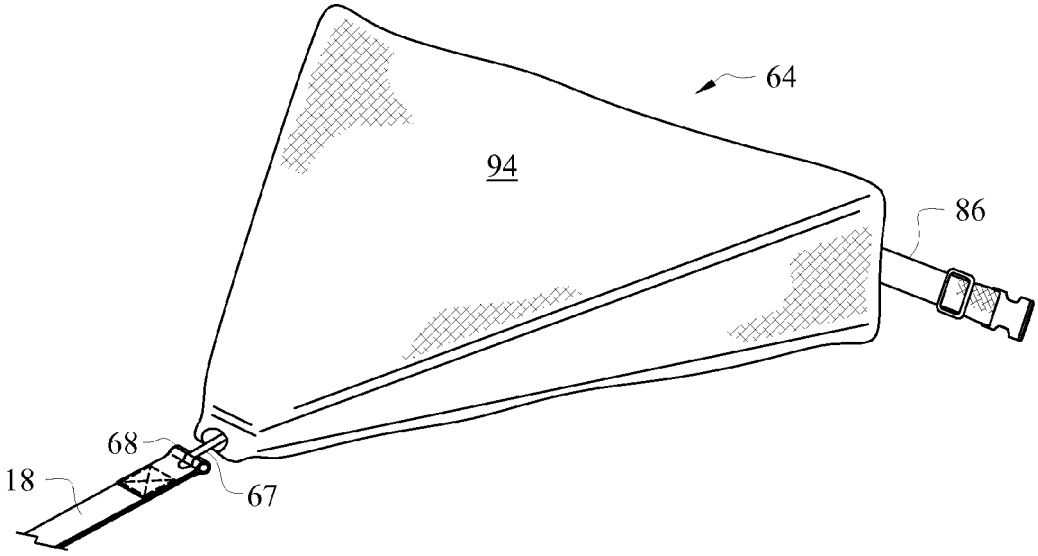
FIG. 6E illustrates the wedge cushion of the present invention.

Referring to FIG. 6E, the wedge cushion 64 is shown covered by a cloth or other suitable material 94 with its attachment mechanism 67 attached to the loops 68 of the strap 18. An optional inter-wedge cushion connecting strap 86 is shown.

Figure 7A:
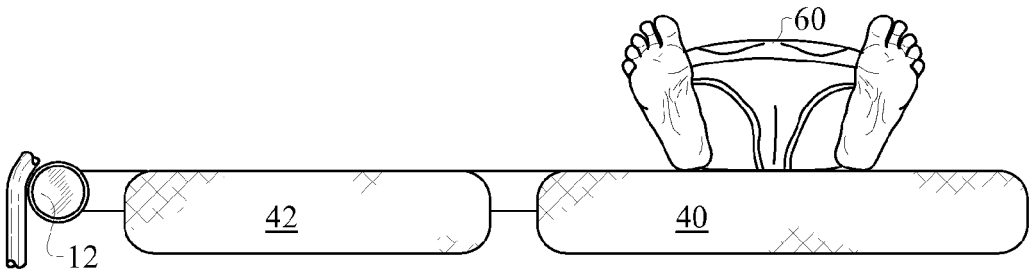
FIGS. 7A through 7F illustrate the operation of the present invention.
Figure 7B:
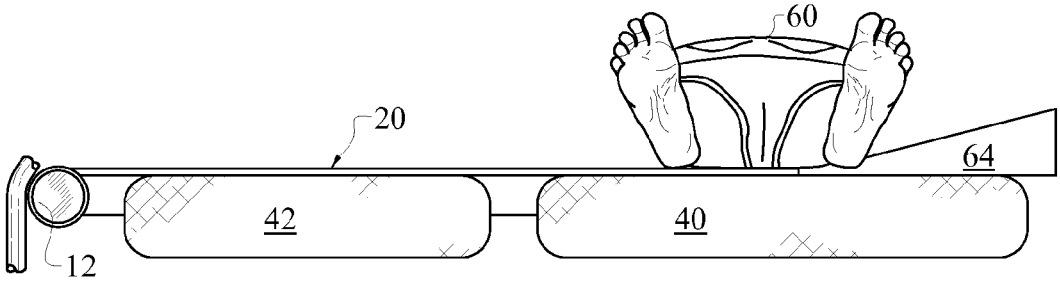
Figure 7C:
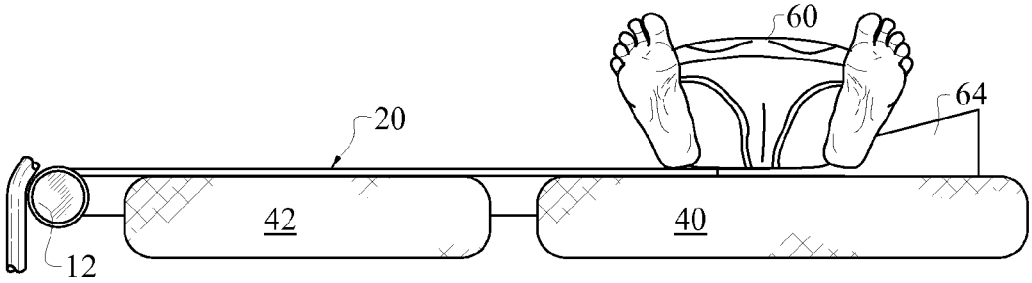
Figure 7D:
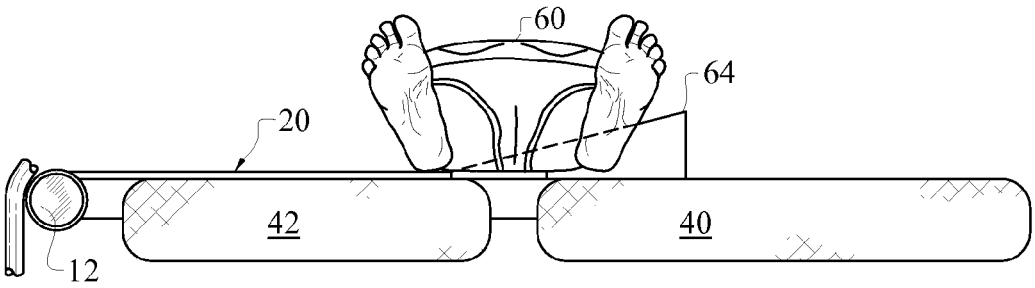
Figure 7E:
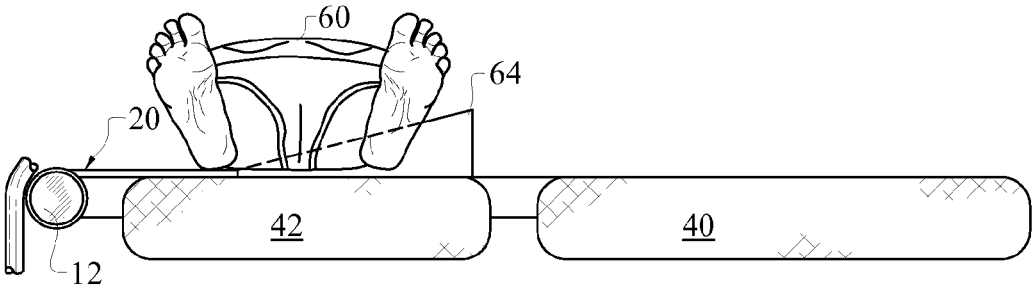
Figure 7F:
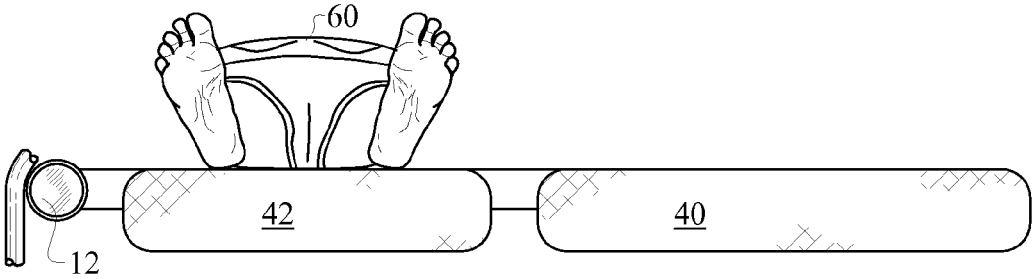

Referring to FIGS. 7A-F, the operation of the present invention is shown. In FIG. 7A, the patient 60 is shown lying on his or her back on a first surface 40. The first surface 40 is positioned next to a second surface 42. Only the reel 12 of the patient transfer winch system is shown for brevity. In FIG. 7B, the strap 20 from reel 12 is passed under the patient 60, preferably under the patient's knees. A similar strap 18 (not visible) is passed under the patient's shoulders or back. The straps are attached to the wedge cushion 64 (previously described). The head cushion 70 is not visible in this example, but is optionally provided. In FIG. 7C, the motor(s) 10/15 have been energized and the straps begin pulling the wedge cushions 64 and hence the wedge cushions 64 move towards the winch. Because of their wedge shape, the wedge cushions 64 first wedge beneath the patient until they pass far enough under the patient 60 to reduce friction between the patient 60 and the surfaces 40/42, In FIG. 7D, some of the friction has been overcome and the wedge cushion 62 begins pushing the patient 60 from the first surface 40 to the destination surface 42. In FIG. 7E, the patient 60 is resting on the destination surface 42. In FIG. 7F, the straps 20 have been removed and the wedge cushion 64 taken away. At this time, the winch system can be moved and used with another patient.

Figure 8A:
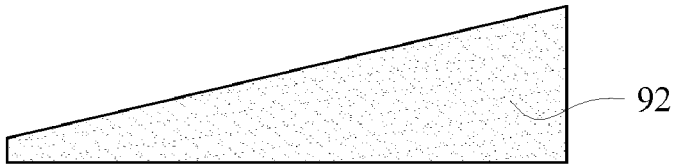
FIGS. 8A and 8B illustrate the operation of the present invention.
Figure 8B:
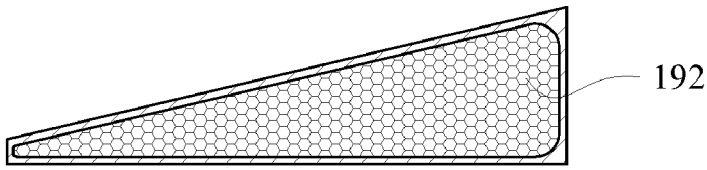

Referring now to FIGS. 8A and 8B, an insert 92/192 for the wedge cushion is shown. In some embodiments, the insert 92 is made of foam rubber or memory foam, as known in the industry, providing a resilient wedge shape to effectively wedge beneath the patient 60 during transfer from one surface 40/20 to another surface 40/42. In other embodiments, the insert 192 is a bladder filled with a liquid or gas, also shaped initially as a wedge, but deforming when wedged beneath the patient 60 such that the portion of the insert 192 that is not beneath the patient fills with liquid or gas that is displaced by the weight of the patient 60. The displaced liquid or gas provides a more rigid and enlarged portion that is not beneath the patient 60 for assisting in pushing the patient 60 from one surface 40/42 to another surface 40/42.

Figure 9:
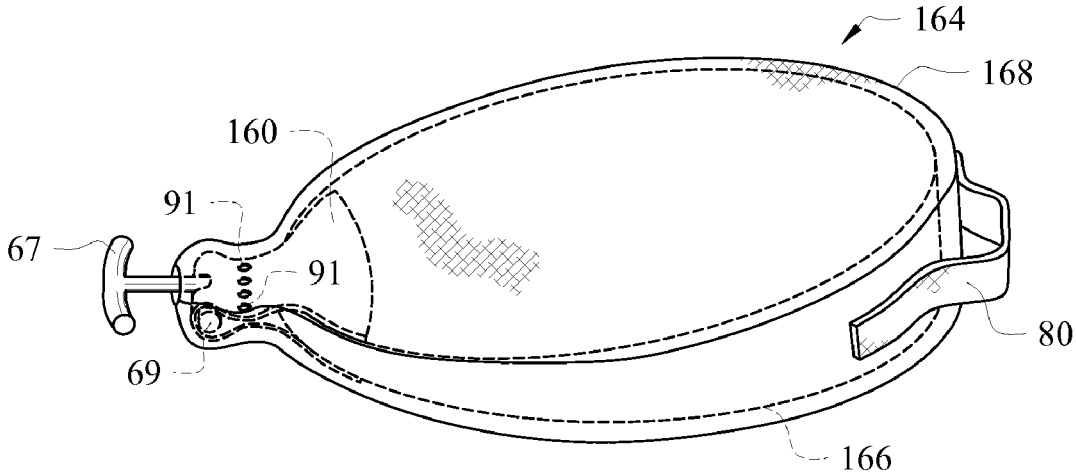
FIG. 9 illustrates an alternate design of the wedge cushion of the present invention.

Referring to FIG. 9, an example of an alternate shaped wedge cushion 164 is shown. Although the preferred shape for the wedge cushion 64 is a triangular wedge, other shapes are anticipated such as circular, oval, square, rectangular, etc. One such shape is shown in FIG. 9, circular wedge 164. The circular wedge 164 has a cover 168 and internal insert 166. The internal insert 166 is made from either a resilient material such as foam rubber or from a bladder as previously described. The circular wedge cushion 164 has a strap 80 for pulling it out from the patient 60. The circular wedge cushion 164 has a stiff member 160 and a T-catch 67 that has a cross member 69 that is secured to a stiff member 160 within the wedge cushion's 164 cover 168. Fasteners 91 such as rivets hold the cross member 69 between sides of the stiff member 160.

In other embodiments, the wedge cushion 64 is shaped differently to achieve the same or similar results. For example, instead of having a flat top surface, an alternate embodiment would have a top surface that is much thinner towards the attach point and stays thinner until half way to the pull straps 80. Other variations in thickness are anticipated without veering from the present invention.

Equivalent elements can be substituted for the ones set forth above such that they perform in substantially the same manner in substantially the same way for achieving substantially the same result.

It is believed that the system and method of the present invention and many of its attendant advantages will be understood by the foregoing description. It is also believed that it will be apparent that various changes may be made in the form, construction and arrangement of the components thereof without departing from the scope and spirit of the invention or without sacrificing all of its material advantages. The form herein before described being merely exemplary and explanatory embodiment thereof. It is the intention of the following claims to encompass and include such changes.

What is claimed is:

1. An apparatus for transferring a patient from a first surface to a second surface, the apparatus comprising:

a winch having two reels;

two straps attached to the reels;

two wedge cushions for pushing the patient in the direction of the winch from the first surface to the second surface, each of the wedge cushions having a cover, an insert and an attachment mechanism for removably attaching the wedge cushions to the two straps, the wedge cushions being thinner at an end having the attachment mechanism and being thicker at a distal end.

2. The apparatus of claim 1, wherein a first reel of the two reels rotate independent of a second reel of the two reels.

3. The apparatus of claim 1, wherein the two reels are turned by two motors.

4. The apparatus of claim 3, wherein the two motors are controlled by a remote control.

5. The apparatus of claim 1, further comprising a head cushion.

6. The apparatus of claim 1, wherein each of the two reels are operatively coupled to hand-cranks.

7. The apparatus of claim 1, wherein the attachment mechanism consists of a bent T-catch and each of the two straps have dual-looped ends for mating with the bent T-catch.

8. The apparatus of claim 1, wherein the insert comprises a resilient foam.

9. A patient transfer winch system for transferring a patient from a first surface to a second surface, the apparatus comprising:

a winch system having a first reel and a second reel, the reels operating independently;

a first strap and a second strap;

a first end of the first strap is attached to the first reel and a first end of the second strap is attached to the second reel, the straps are adapted to wrap around the reels as the winch system turns the reels;

two wedge cushions for elevating and pushing the patient in the direction of the winch from the first surface to the second surface, each wedge cushion having a cover, an insert and a means for attaching to a second end of the straps;

a pull strap attached to each of the wedge cushions on a surface distal to the means for attaching.

10. The patient transfer winch system of claim 9, wherein the means for attaching is a T-catch and the second end of the straps have loops for engaging with the T-catch.

11. The patient transfer winch system of claim 9, wherein a top surface of each of the wedge cushions is substantially triangular in shape and a side surface of each of the wedge cushions forms a wedge shape, the wedge shape being thinner at an end close to the means for attaching.

12. The patient transfer winch system of claim 9, wherein the insert is made from a resilient foam.

* * * * *